US007900926B2

(12) United States Patent
Marchesani

(10) Patent No.: US 7,900,926 B2
(45) Date of Patent: Mar. 8, 2011

(54) LOW/MAX CARD GAME METHOD AND APPARATUS

(76) Inventor: Nicholas P. Marchesani, Brigantine, NJ (US)

( * ) Notice: Subject to any disclaimer, the term of this patent is extended or adjusted under 35 U.S.C. 154(b) by 0 days.

(21) Appl. No.: 12/188,817

(22) Filed: Aug. 8, 2008

(65) Prior Publication Data

US 2009/0102127 A1 Apr. 23, 2009

Related U.S. Application Data

(63) Continuation of application No. 09/168,072, filed on Oct. 8, 1998, now abandoned.

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | | |
|---|---|---|---|---|---|
| 4,659,087 | A | * | 4/1987 | Shen et al. | 273/274 |
| 5,098,107 | A | | 3/1992 | Boylan et al. | |
| 5,248,142 | A | * | 9/1993 | Breeding | 273/138.1 |
| 5,282,633 | A | | 2/1994 | Boylan et al. | |
| 5,294,128 | A | | 3/1994 | Marquez | |
| 5,314,194 | A | * | 5/1994 | Wolf | 273/292 |
| 5,322,295 | A | | 6/1994 | Cabot et al. | |
| 5,328,189 | A | * | 7/1994 | Malek | 273/292 |
| 5,407,209 | A | * | 4/1995 | Prerost | 273/292 |
| 5,476,265 | A | | 12/1995 | Miller et al. | |
| 5,494,295 | A | * | 2/1996 | Potter et al. | 273/292 |
| 5,597,162 | A | * | 1/1997 | Franklin | 273/292 |
| 5,613,682 | A | | 3/1997 | Otuzbiryan | |
| 5,628,514 | A | | 5/1997 | Nguyen et al. | |
| 5,632,486 | A | | 5/1997 | Mkrtchyan | |
| 5,678,821 | A | * | 10/1997 | Hedman | 273/292 |
| 5,692,755 | A | | 12/1997 | Gutierrez | |
| 5,735,524 | A | | 4/1998 | Wisted | |
| 5,741,012 | A | | 4/1998 | So et al. | |
| 5,788,241 | A | * | 8/1998 | Ung | 273/292 |
| 5,810,354 | A | * | 9/1998 | Banyai | 273/292 |
| 5,857,677 | A | * | 1/1999 | Sum Chau | 273/292 |
| 5,863,042 | A | * | 1/1999 | Lo | 273/292 |
| 5,928,081 | A | * | 7/1999 | Bochichio et al. | 463/13 |
| 5,984,310 | A | * | 11/1999 | English | 273/292 |
| 6,135,453 | A | * | 10/2000 | Srichayaporn | 273/292 |
| 6,206,374 | B1 | * | 3/2001 | Jones | 273/292 |

OTHER PUBLICATIONS

John Scarne, Scarne's Complete Guide to Gambling, New York: Simon & Schuster, pp. 582-583 (1961). Walter Gibson, Hoyles Modern Encyclopedia of Card Games, New York: Doubleday & Company, Inc., pp. 231, 238, 258, 263, and 266 (1980).

* cited by examiner

*Primary Examiner* — Alvin A Hunter
*Assistant Examiner* — Dolores Collins
(74) *Attorney, Agent, or Firm* — Hogan Lovell US LLP

(57) ABSTRACT

A card game method and apparatus is played with a standard deck of cards and a game table having a dealer area and a plurality of player areas. The dealer deals sets of cards to each of a plurality of players and to the dealer itself. An equal number of cards is dealt to each player. The equal number is preferably from 3 to 7. Each player makes an initial wager. After receiving their cards, each player and the dealer split at least three of their cards into two half-hands, a first half-hand having a "LOW" value and a second half-hand having a "HIGH" value. A player wins if both a) that player's LOW hand is lower than the dealer's LOW hand and b) that player's HIGH hand is higher than the dealer's HIGH hand. A number a variations of the game are also described.

36 Claims, 7 Drawing Sheets

LOW/MAX CARD GAME METHOD AND APPARATUS

CROSS-REFERENCE TO RELATED APPLICATION

This application is a continuation of U.S. patent application Ser. No. 09/168,072 filed Oct. 8, 1998 now abandoned which is expressly incorporated herein by reference in its entirety.

BACKGROUND OF THE INVENTION

1. Field of the Invention

The present invention relates generally to card games and, in particular, to casino and the like card games wherein players bet on hands of cards dealt to them by a dealer. The present invention provides a novel card game method and apparatus.

2. Description of the Related Art

A standard deck of playing cards typically has 52 cards, including four of each of the following cards: aces; twos through tens; jacks; queens; and kings. Standard decks typically also include two jokers which are not usually used in certain games.

A great variety of games are known in the art wherein a dealer hands out a set of cards to each player. Two well known card games are Black Jack and Poker. As with most card games, there are a large number of versions of both Black Jack and Poker known in the art.

Additional exemplary card games are illustrated in U.S. Pat. No. 4,659,087 (Shen et al.); U.S. Pat. No. 5,098,107 (Boylan et al.); U.S. Pat. No. 5,282,633 (Boylan et al.); U.S. Pat. No. 5,294,128 (Marquez); U.S. Pat. No. 5,322,295 (Cabot et al.); U.S. Pat. No. 5,476,265 (Miller et al.); U.S. Pat. No. 5,613,682 (Otuzbiryan); U.S. Pat. No. 5,628,514 (Nguyen et al.); U.S. Pat. No. 5,632,486 (Mkrtchyan); U.S. Pat. No. 5,692,755 (Gutierrez); U.S. Pat. No. 5,735,524 (Wisted); and U.S. Pat. No. 5,741,012 (So et al.). These patents show a variety of games, including, among other things, card games using tables with peripheral player areas and a centrally located dealer area.

As one example, U.S. Pat. No. 4,659,087 shows a casino game wherein the players and the dealer each receive four cards that are scored by splitting them into two "HIGH" groups. As another example, U.S. Pat. No. 5,294,128 shows a multiple hand variation of the card game HI-LO poker wherein players are dealt six cards that are divided into a one-card "HIGH" hand, a two-card "HIGH" hand, and a three-card "LOW" hand. As another example, U.S. Pat. No. 5,628,514 shows a method of playing a card game using a deck of 360 cards from 15 modified decks, wherein the card game is played according to either a "HIGH" winning scheme or a "LOW" winning scheme. As yet another example, U.S. Pat. No. 5,322,295 shows a multiple hand card game wherein the players are dealt supplemental cards with the desired goal of attaining a value higher than that of the dealer without exceeding a value of, for example, 21.

Although there are a great many games known in the art, there remains a continued need for games that are enjoyable for players of all skill levels and that are economically and functionally desirable for casino use.

SUMMARY OF THE INVENTION

The present invention provides a unique card game method and apparatus that can be both enjoyable for all players and desirable for a casino or house and that can overcome problems in the existing art.

According to a first aspect of the invention, a method of playing a card game is provided which includes the steps of: providing a standard deck of cards; providing a game table having a dealer area and a plurality of player areas; having a dealer deal sets of cards to each of a plurality of players and to the dealer itself, an equal number of cards being dealt to each player, said equal number being from 3 to 7 (most preferably between 3 and 5); having each player make a wager prior to viewing the face value of their respective cards; having each player split at least three of their respective cards into two half-hands, a first half hand having a LOW value and a second half-hand having a HIGH value; having the dealer split at least three of his cards into two half-hands, a first half hand having a LOW value and a second half-hand having a HIGH value; designating a player as a winner if both a) that player's LOW hand is lower than the dealer's LOW hand and b) that player's HIGH hand is higher than the dealer's HIGH hand.

In a preferred embodiment, the step of having a dealer deal includes dealing 4 cards to each player and wherein the steps of splitting the player's and dealer's cards into half-hands includes making each half-hand with 2 cards.

In a preferred embodiment, the step of designating a player as a winner if both a) that player's LOW hand is lower than the dealer's LOW hand and b) that player's HIGH hand is higher than the dealer's HIGH hand is based on valuing aces as either 1 or 11, valuing 2's through 10's as 2 through 10, respectively, and valuing jacks, queens and kings as 10.

In a preferred embodiment, a player loses when either: a) both the player's HIGH and LOW half-hands lose; b) one of the player's half-hands loses and the other of the player's half-hands pushes; or c) both of the player's HIGH and LOW half-hands push.

In a preferred embodiment, a player pushes when either: a) one of the player's half-hands wins and the other of the player's half-hands loses; or b) one of the player's half-hands wins and the other of the player's half-hands pushes.

In a preferred embodiment, the dealer area has a location for a chip rack, a location for receiving a HIGH half-hand and a location for receiving a LOW half-hand and the player areas each have a chip wager region, a location for receiving a HIGH half-hand and a location for receiving a LOW half-hand.

According to another aspect of the invention, a card game apparatus is provided which includes: a) a standard deck of cards; b) a game table having a curved side with a plurality of player areas and an opposite side with a central dealer area; c) the central dealer area including: a chip rack; a HIGH half-hand region designated by indicia printed on a top surface of the game table; a LOW half-hand region designated by indicia printed on the top surface of the game table; d) each of the player areas including: a chip region designated by printing on the surface of the game table; a HIGH half-hand region designated by indicia printed on the surface of the game table; and a LOW half-hand region designated by indicia printed on the surface of the game table.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention will become more fully understood from the detailed description given hereinbelow and the accompanying drawings which are given by way of illustration only, and are not limitative of the present invention, and wherein.

DETAILED DESCRIPTION OF THE PREFERRED EMBODIMENTS

The games according to the preferred embodiments of the present invention are referred to herein by the preferred trade name LOW-MAX™.

Figure 1:
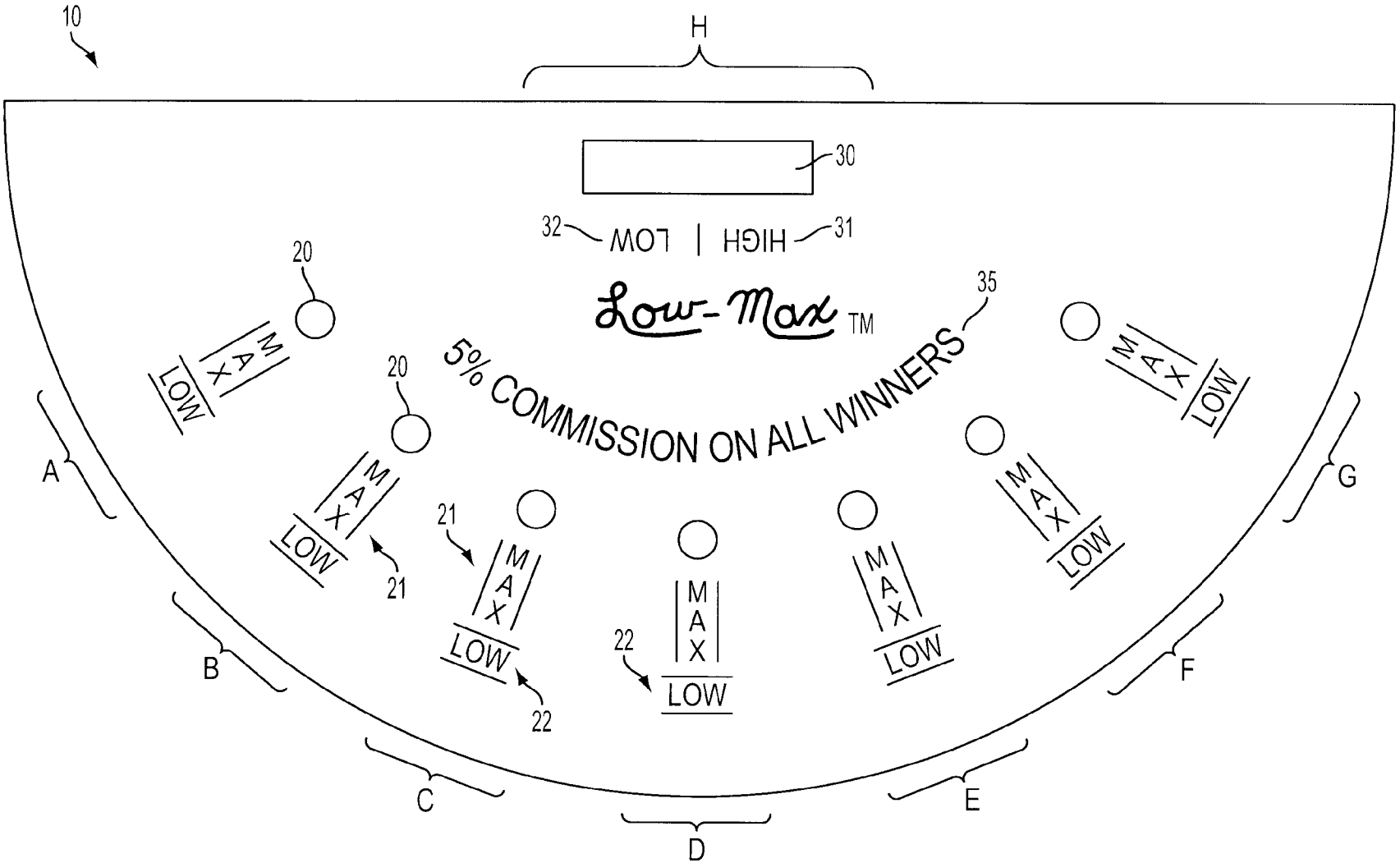
FIG. 1 is a top view of a top surface of a game table according to a first embodiment of the invention.

The preferred embodiments of the LOW-MAX game are preferably conducted with a standard (52 card) deck by a single dealer. Preferably, the deck is a regulation deck. As shown in FIG. 1, the LOW-MAX game preferably includes a game table 10 that can be sized, for example, similar to a common Black Jack table. The game table 10 preferably includes a plurality of player areas for a plurality of players. Most preferably, the table 10 includes seven player areas A-G, as shown, and a central dealer area H.

Figure 2:
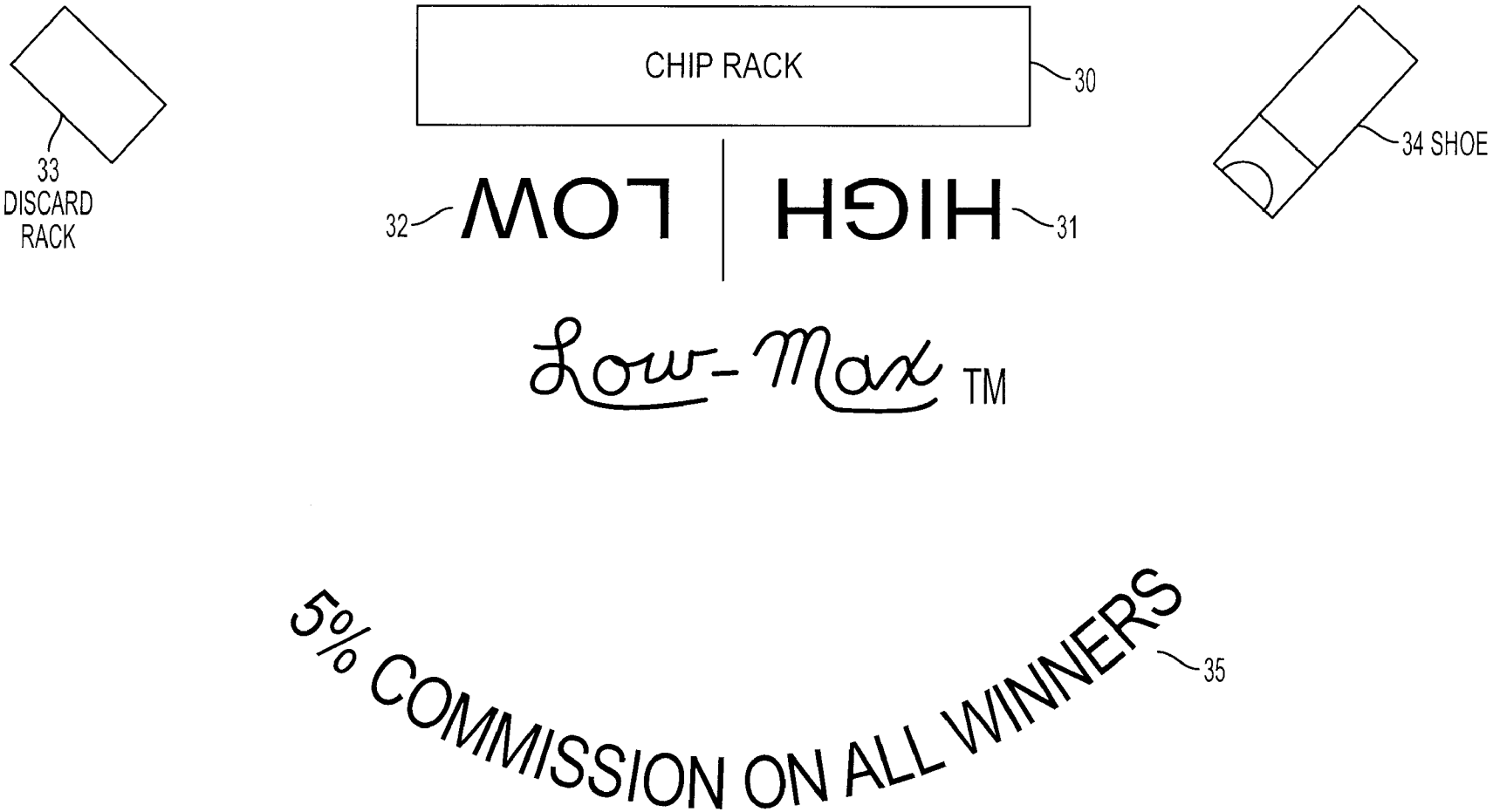
FIG. 2 is a top view of a dealer area of the game table shown in FIG. 1 also having a discard rack and a card shoe thereon.

FIG. 2 shows a close-up view of the dealer area H in FIG. 1. As shown, the dealer area H preferably includes: a chip rack 30; a HIGH half-hand region 31; a LOW half-hand region 32; a discard rack 33; and a card shoe 34. As shown, the dealer area can also include other indicia thereon such as the LOW-MAX tradename and indicia 35 indicating a commission to be received by the house (5% in the illustrated embodiment).

Figure 3:
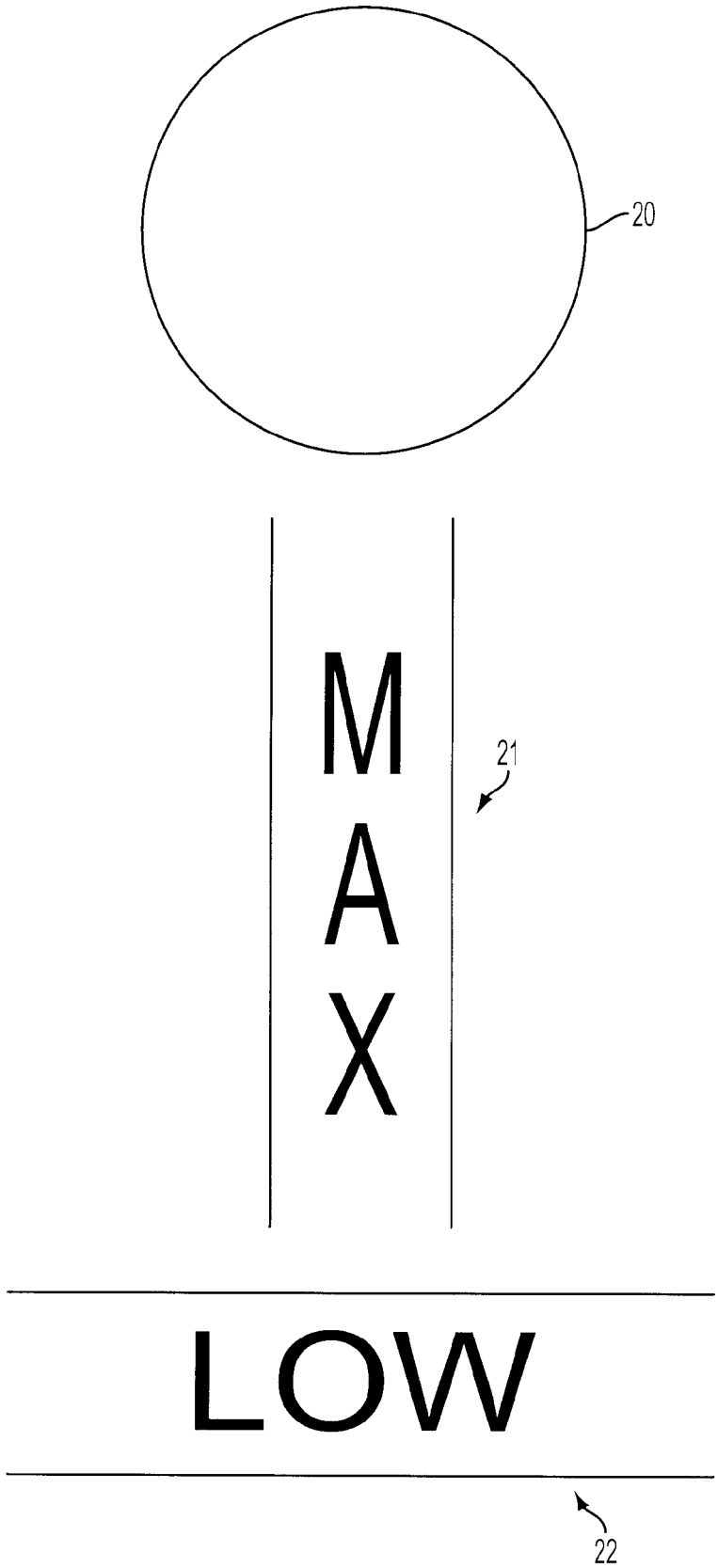
FIG. 3 is a top view of a player area of the game table shown in FIG. 1.

On the other hand, FIG. 3 shows a close-up view of one of the player areas A-G in FIG. 1. As shown, each player area preferably includes: a chip region 20; a HIGH half-hand region 21; and a LOW half-hand region 22.

FIGS. 2 and 3 illustrate preferred designs of the dealer and player areas, respectively. It is contemplated, however, that these areas can be modified as desired as long as at least one version of the LOW-MAX game can still be played (as discussed below). As shown in FIG. 1, the table is also preferably semi-circular (i.e., curved on one side), with the dealer area H proximate a center and the player areas around a semi-circular periphery as shown. It is also contemplated, however, that the size and shape of the table can be also modified as desired as long as at least one version of the LOW-MAX game can still be played (as discussed below).

In a first basic embodiment of the invention, the players and the dealer are each dealt four cards from a standard deck of cards. As noted, a single standard deck is preferably used. The players then arrange the four cards into two half-hands (i.e., into two two-card hands). The players make one half-hand as low as possible (a LOW hand) and the other half-hand as high as possible (a HIGH hand). The values of each half-hand are calculated by adding the face values of the cards.

According to a first preferred embodiment, the cards are valued as follows: aces at either 1 or 11; twos through tens at numbers equal to the numbers on their respective faces of 2 through 10; jacks, queens and kings each at a value of 10. The lowest possible hand is thus a 2 (with two aces) and the highest possible hand is thus a 22 (also with two aces). In one alternative embodiment, the cards can be valued as follows: aces at 1; twos through tens at numbers equal to the numbers on their respective faces of 2 through 10; jacks at 11; queens at 12; and kings at 13. In another preferred embodiment, the cards are valued the same as in a game of poker—so that the lowest possible hand would be a two and a three and the highest possible hand would be two aces. It is noted that in this poker-value embodiment, straights and flushes would not be possible.

Prior to dealing the cards, each player makes an initial monetary wager or bet. Although the game could be played without a monetary wager, or even without any betting, monetary wagering is much more preferred. Preferably, each player bets by placing chips on the player's chip region 20 within his or her respective player area. Then, the dealer deals four cards face down to each player and to himself. The dealer preferably deals: (a) a single face-down card to the player at the position G; (b) a single face-down card to each subsequent player in turn in a direction clockwise around the table; (c) a single face-down card to the dealer himself. The dealer preferably repeats steps (a)-(c) until the players and the dealer each have four cards. The players and the dealer then split their cards into a "LOW" two-card half-hand and a "HIGH" two-card half-hand.

As discussed in more detail below, if a player's LOW half-hand is lower than the dealer's LOW half-hand and if the player's HIGH half-hand is higher than the dealer's HIGH half-hand, then that player "wins." That is, the player must win both the HIGH and the LOW half-hands to win the hand. When a player wins the hand, the player preferably receives winnings in a 1:1 ratio, receiving an added amount equal to his wager minus a house commission. Preferably, the house commission is 5% of the player's wager. If the player loses the hand, the player loses his wager.

The present LOW-MAX game can be exciting for players of all skill levels—from the novice player to the advanced player. It can also be a game that is economically desirable for the casino or house and that is simple for the casino or house to implement (e.g., requiring only a single dealer without a high degree of dealer expertise). The LOW-MAX game is thus beneficial for both the players and the casino or house.

A variety of modified versions or options of the LOW-MAX card game are contemplated. That is, as with many card games, a number of different versions or options can be played. Preferred alternative versions or options are discussed below.

Versions With Replacement Cards

Figure 4:
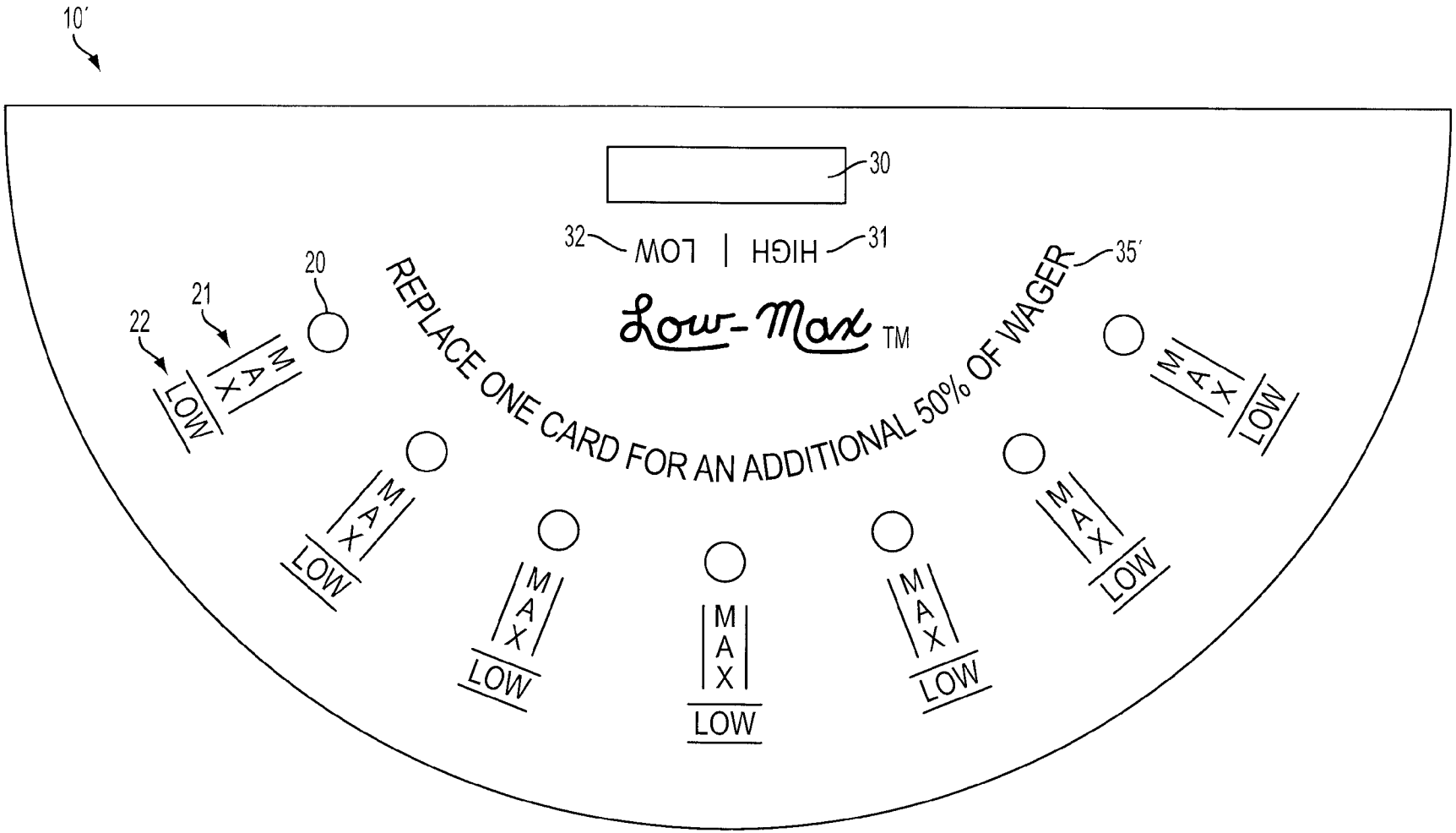
FIG. 4 is a top view of a top surface of a game table according to a second embodiment of the invention.
Figure 5:
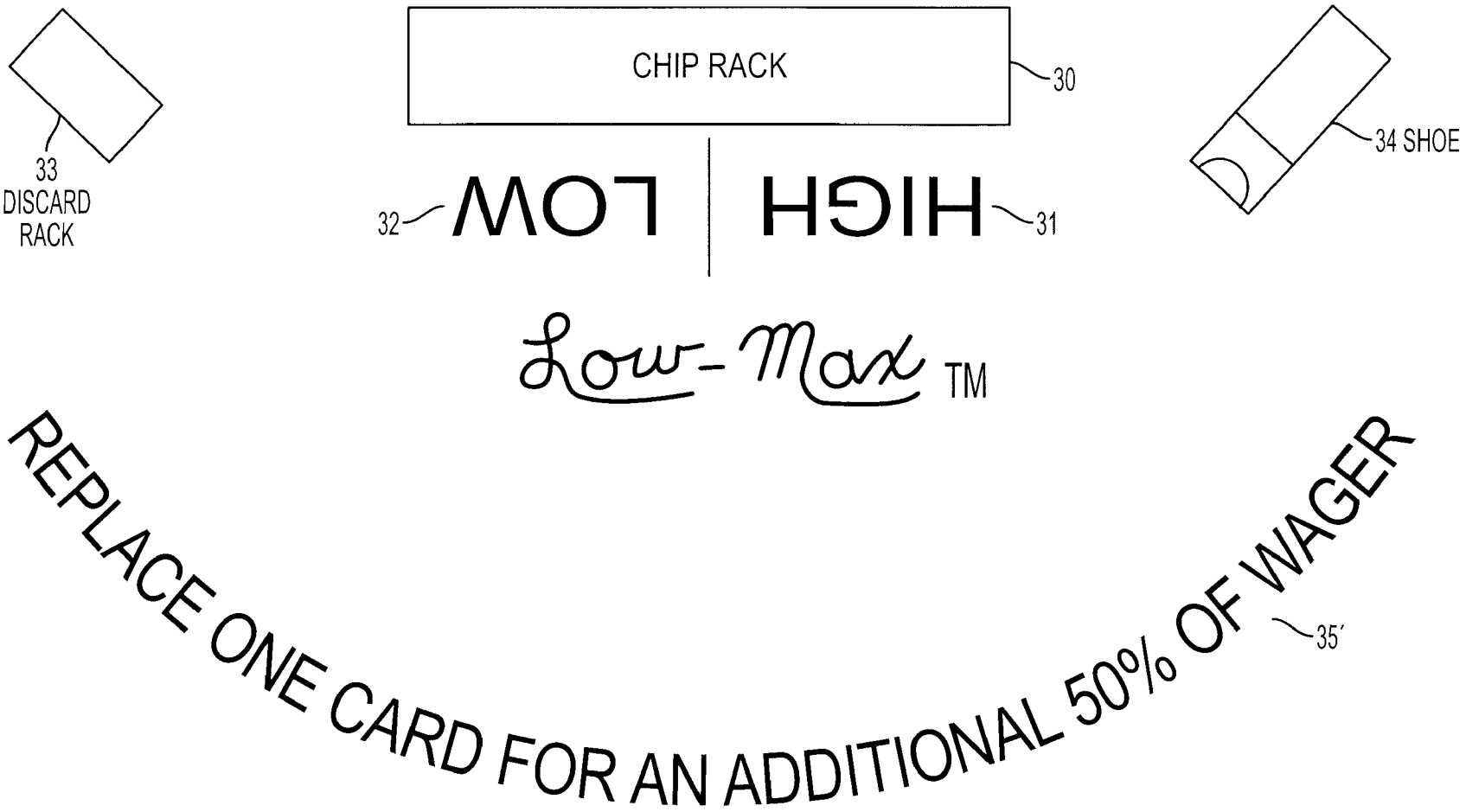
FIG. 5 is a top view of a dealer area of the game table shown in FIG. 4 also having a discard rack and a card shoe thereon.
Figure 6:
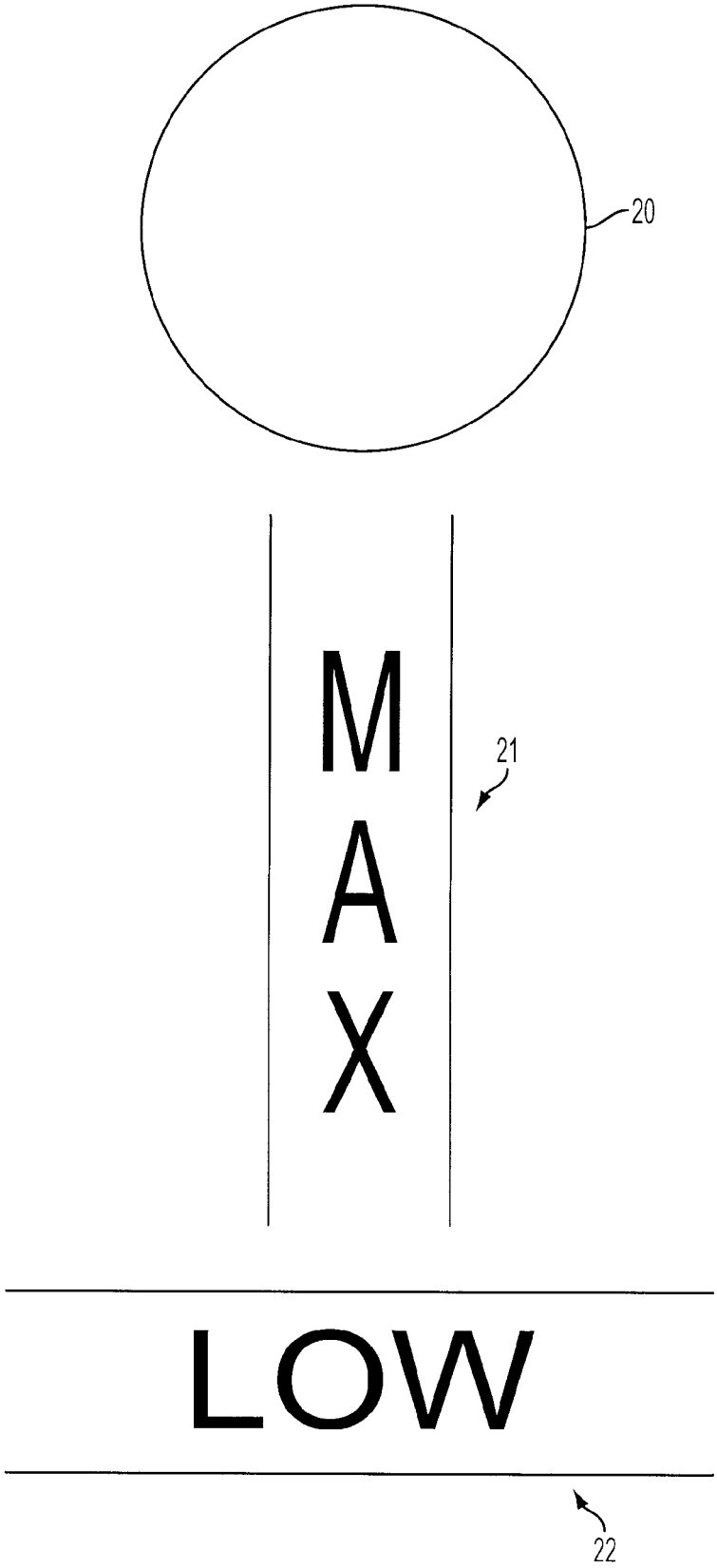
FIG. 6 is a top view of a player area of the game table shown in FIG. 4.
Figure 7:
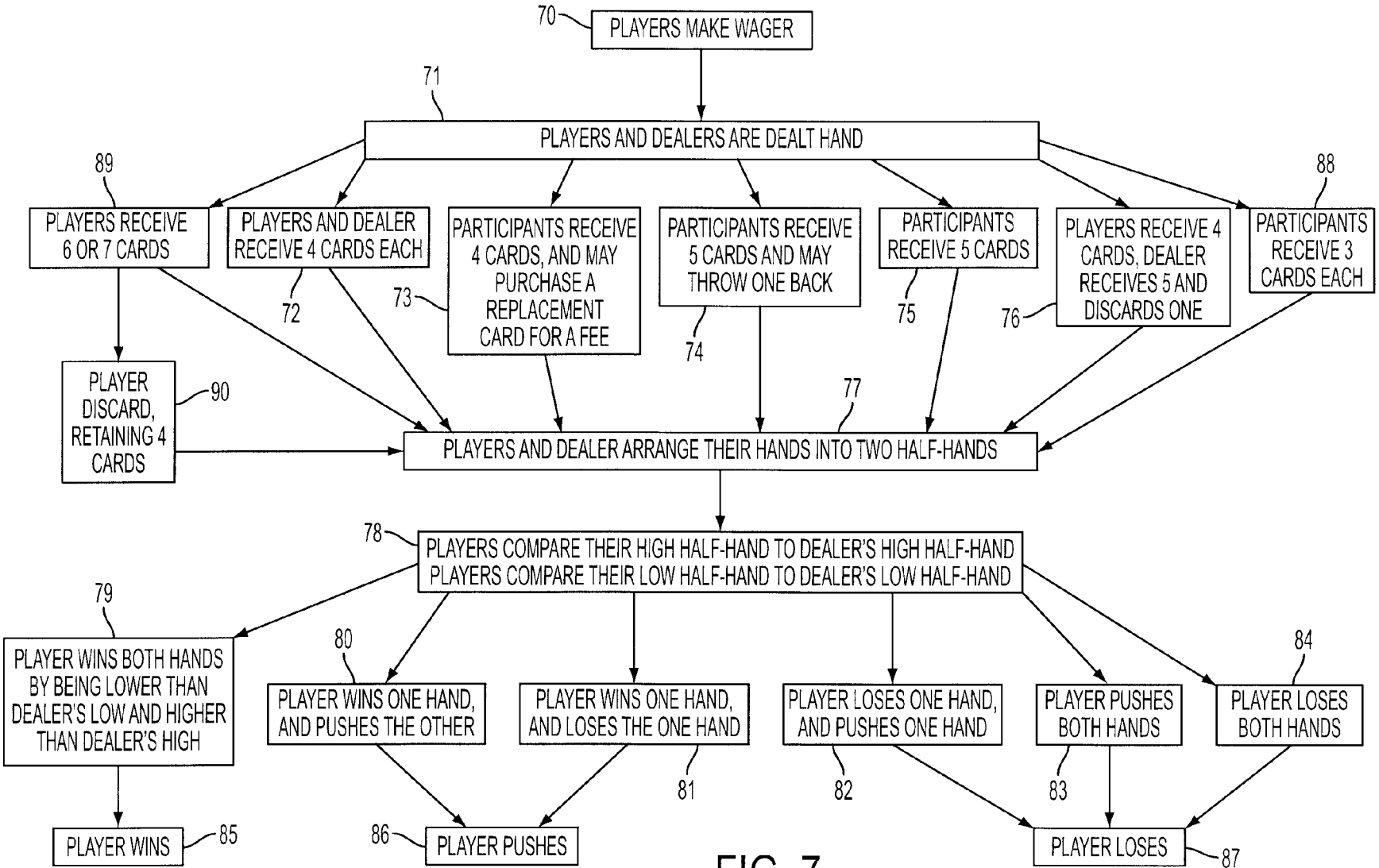
FIG. 7 is a flowchart of the steps of an embodiment of the present invention.

FIGS. 4-6 show a first modified version of the LOW-MAX game, wherein after the players and the dealer are dealt four cards, a single replacement card can be purchased by any player upon the payment of a predetermined replacement fee. The replacement fee is preferably an additional 50% of the initial wager. To receive the replacement card, the player must both (a) discard a card (e.g., face down) and (b) pay the replacement fee. Only then should the dealer deal that player a new face-down replacement card. Although the table 10' for this first modified version can be the same as that for the first basic embodiment discussed above, as shown in FIGS. 4 and 5 the table 10' preferably includes indicia 35' identifying that a replacement card can be obtained upon the payment of a replacement fee.

In another modified version of the game, after the players and the dealer are dealt their four cards, the dealer can draw a single replacement card. Preferably, the dealer can only draw a replacement card when either: (a) 3 of the 4 cards received by the dealer are equal in value; or (b) 3 of the 4 cards received by the dealer have a value between 5 and 10 (i.e., 6's, 7's, 8's and 9's). The latter modified version is preferably used in conjunction with the modified version enabling players to draw an additional card with the payment of a 50% replacement fee.

Five-Card Versions

In other modified versions of the game, each player and the dealer can be dealt five cards. In a first variation, the players and the dealer can each throw back one card. Then, the remaining four cards can be used as described above. In a second variation, the players and the dealer can use each card—with one of the HIGH or LOW hands being based on the total value of 3 cards and the other of the hands being based on the total value of the remaining 2 cards.

Three-Card Versions

In other modified versions of the game, each player and the dealer can be dealt three cards. In this regard, one of the HIGH or LOW hands can be based on the total value of 2 cards and the other of the hands can be based on the total value of the remaining 1 card. In one variation, the players and the dealer can each receive one "free" hit after being dealt 3 cards (so that the player's hand thus becomes based on two two-card half-hands). In another variation, the players and the dealer can be dealt 3 cards, and the players can be allowed to purchase a single replacement card for an additional 50% of their initial bet.

Four-Card/Five-Card Versions

In another modified version of the game, each of the players are dealt four cards and the dealer is dealt five cards. The dealer must then discard one card to make two two-card half-hands. In this modified version, the dealer preferably cannot draw and additional cards, but each of the players preferably may purchase a single replacement card for an additional 50% of the bet.

Player Banking Versions

In another modified version of the game, any player may choose to "bank" a hand for a fee. Preferably, the fee is a 5% commission on all of the banking-players winnings in the hand. In order to "bank" a hand, a player must have enough money to pay all of the remaining players combined. Preferably, the player banking their hand must play against the dealer first and, preferably, for no more than their last bet against the dealer. Then, each of the hands of the other players are compared to the dealer's hand. For each respective hand, the banking player either pays the other player's winnings (if the other player wins) or receives the other player's wager minus a % commission (if the dealer's hand wins). Preferably, the dealer must bank at least every other hand so that players cannot bank two games in a row.

In another modified version of the game, any player may "co-bank" a hand with the dealer for a fee. Preferably, the fee is 5% of all the co-banking player's winnings on that hand. In order to co-bank, a player must put forth 50% of all of the wagers from the other players combined. Preferably, a dealer uses the co-banker's hand instead of the dealer's hand in this case. In this version, the co-banker does not play against the dealer and the wins and losses get split in half between the dealer and the co-banker (minus the commission, which is preferably 5%, of the co-banker's winnings as discussed above).

Winning/Losing

In games wherein no draws are permitted (e.g., where the players are not permitted to draw a replacement card) as well as in games wherein draws are permitted, the payoff on all bets is preferably 1 to 1, and all winners are preferably charged a commission fee (preferably 5%).

Preferably, both half-hands must win to win a hand. That is, the player's LOW hand must be lower than the dealer's low hand, and the player's HIGH hand must be higher than the dealer's high hand.

Preferably, a player "loses" when either: (a) both the player's HIGH and LOW hands lose; (b) one half-hand loses and the other half-hands pushes (i.e., is equal in value to the dealer's hand); or (c) both of the HIGH and LOW half-hands push.

Preferably, a player's hand "pushes" when either: (a) one half-hand wins and the other half-hand loses; or (b) one half-hand wins and the other half-hand pushes. When a player's hand pushes, the player's wager can, for example, remain on the table so as to "push" over and be applied to the subsequent hand.

Four-Of-A-Kind Options

In one variation of the game, a player can receive a set reward for receiving four-of-a-kind. For example, a set monetary value can be awarded to a player that receives four-of-a-kind.

In another variation of the game, a player can receive a progressive jackpot for receiving four-of-a-kind. In this regard, the player with a four-of-a-kind can win, for example, a set amount for each hand that is being played. That is, a certain monetary value can be awarded to the player that receives the four-of-a-kind for each player at the table at that time.

The method for providing a progression jackpot can be like that known in the art for other card games.

ADVANTAGES AND MODIFICATIONS

As discussed above, the present invention provides a game method and apparatus that can be enjoyable for players of all skill levels and that can be economically and functionally desirable for casino use.

The preferred embodiments of the invention provide a game that is simple enough for a novice player and yet exciting enough for skilled players. According to the more preferred embodiments of the invention, wagers or bets are preferably only made prior to dealing the cards—except that a replacement card can be purchased in one preferred modified version of the game. This, among other things, simplifies the game for novice players.

While the present invention has been described with reference to the preferred embodiments of the invention, it is contemplated that the same can be varied as would be apparent to those skilled in the art based on this disclosure without departing from the spirit and scope of the invention. Any and all such modifications are intended to be included within the scope of the following claims. As some exemplary modifications, various modified versions of the present LOW-MAX game described herein can be combined together where appropriate. For example, the variations, versions and options can be combined together as appropriate, such as varying valuation, numbers of cards dealt and/or in the hi and low half-hands, replacement cards, draws, banking, progression, etc., as desired. It is also contemplated that additional embodiments of the game can include community cards (e.g., one or two commonly used cards for each player as is known in the art). It is also contemplated that additional less preferred embodiments of the game can also include different numbers of cards dealt to each player. Although the most preferred embodiments are discussed above, other less preferred versions can include for example six or seven cards dealt to each player. In the latter case, the half-hands can be divided in any manner; preferably, however, each half-hand has at least two cards; and, more preferably, each half-hand has two cards and the remaining cards are thrown back.

What is claimed is:

1. A method of playing a card game, comprising the steps of:

providing a standard deck of cards each of said cards having a face value;

having a dealer deal a set of cards from the standard deck of cards to each of a plurality of players and to the dealer itself, an equal number of cards being dealt to each player, said equal number being from 3 to 7; wherein the step of having a dealer deal a set of cards to each of a plurality of players and to the dealer itself further comprises:

providing a game table including a dealer area and a plurality of player areas; and wherein the dealer deals the set of cards into the dealer area and the plurality of player areas at the start of each game;

having each player make a single wager prior to viewing the face value of their respective cards;

having each player split their respective set of cards into a total number of cards in two half-hands, by forming a first half-hand having a LOW value card combination and a second half-hand having a HIGH value card combination wherein the total number of cards in either half-hand does not exceed the total number of cards in the other half-hand by more than one card;

having the dealer split its set of cards into two half-hands, a first half-hand having a LOW value and a second half-hand having a HIGH value wherein the total number of cards in either half-hand does not exceed the total number of cards in the other half-hand by more than one card;

designating a player as a winner if both (a) that player's LOW hand is lower than the dealer's LOW hand and (b) that player's HIGH hand is higher than the dealer HIGH hand;

and further including the step of allowing a player to bank a hand for a fee provided the banking player has enough money to pay 100% of all potentially winning wagers to all remaining non-banking players.

2. The method of claim 1, wherein each of said players and said dealer are dealt 4 cards, wherein each of said players is permitted to discard one of said 4 dealt cards dealt to them and draw a replacement card upon the payment of a fee, and wherein said dealer is permitted to discard a card and draw a replacement card only if said 4 dealt cards dealt to said dealer meet a predetermined criteria.

3. The method of claim 2, wherein said predetermined criteria comprises when at least 3 of said 4 dealt cards dealt to said dealer are equal in value and when at least 3 of said 4 dealt cards dealt to said dealer are one of a 6, 7, 8, or 9.

4. The method of claim 1, wherein said step of having a dealer deal includes dealing 4 cards to each player and wherein said steps of splitting the player's and dealer's cards into half-hands includes making each half-hand with 2 cards.

5. The method of claim 1, wherein said step of designating a player as a winner if both (a) that player's LOW hand is lower than the dealer's LOW hand and (b) that player's HIGH hand is higher than the dealer's HIGH hand is based on valuing aces as either 1 or 11, valuing 2's through 10's as 2 through 10, respectively, and valuing jacks, queens and kings as 10.

6. The method of claim 1, wherein said step of designating a player as a winner if both (a) that player's LOW hand is lower than the dealer's LOW hand and (b) that player's HIGH hand is higher than the dealer's HIGH hand is based on poker values of the cards.

7. The method of claim 1, wherein said step of designating a player as a winner if both (a) that player's LOW hand is lower than the dealer's LOW hand and (b) that player's HIGH hand is higher than the dealer's HIGH hand is based on valuing aces as 1, valuing 2's through 10's as 2 through 10, respectively, and valuing jacks as 11, queens as 12 and kings as 13.

8. The method of claim 1, wherein, after placing said wagers and prior to splitting the dealt card into half-hands, a single replacement card can be purchased by any player upon the payment of a predetermined replacement fee and discarding one of said dealt cards, and wherein, prior to splitting the dealer's dealt cards into half-hands, said dealer can draw a single replacement card under predefined conditions.

9. The method of claim 8, wherein said replacement fee is 50% of the initial wager.

10. The method of claim 1, further comprising, after said step of designating a player as a winner, the step of giving that player winnings in the amount of a 1 to 1 pay-out minus a commission fee.

11. The method of claim 1, further comprising, the step of designating a player's hand as a push when either (a) one of the player's half-hands wins and the other of the player's half-hands loses; or (b) one of the player's half-hands wins and the other half-hand ties a non-losing half-hand of said dealer.

12. The method of claim 1, further comprising, the step of designating a player's hand as a loser when either (a) both of the player's half-hands lose to respective half-hands of said dealer; or (b) one of the player's half-hands loses to a first corresponding half-hand of said dealer and the player's other half-hand ties a second corresponding half-hand of said dealer.

13. The method of claim 1, wherein the players and dealer are dealt three cards.

14. The method of claim 1, wherein the players and dealer are dealt four cards.

15. The method of claim 14 further comprising the step of giving the player an award if the player is dealt a hand of four-of-a-kind.

16. The method of claim 1, wherein the players and dealer are dealt five cards.

17. The method of claim 1, wherein the players and dealer are dealt six cards.

18. The method of claim 1, wherein the players and dealer are dealt seven cards.

19. The method of claim 1, further comprising after the step of placing a wager and prior to the step of splitting the cards into half-hands, the step of each player and said dealer discarding a predetermined number of the dealt cards.

20. The method of claim 19, wherein said predetermined number of the cards to be discarded is one card.

21. The method of claim 19, wherein said predetermined number of the cards is the amount of cards necessary to leave each said player and said dealer with 4 cards.

22. The method of claim 19, wherein the dealer is dealt 4 cards and each player is dealt 7 cards and each player discards 3 cards prior to splitting the cards into half-hands.

23. The method of claim 19, wherein each player and the dealer is dealt 7 cards and each discards 3 cards prior to splitting the cards into half-hands.

24. The method of claim 19, wherein the dealer is dealt 4 cards and each player is dealt 6 cards and each player discards 2 cards prior to splitting the cards into half-hands.

25. The method of claim 19, wherein each player and the dealer is dealt 6 cards and each discards 2 cards prior to splitting the cards into half-hands.

26. The method of claim 19, wherein the dealer is dealt 4 cards and each player is dealt 5 cards and each player discards 1 card prior to splitting the cards into half-hands.

27. The method of claim 19, wherein each player is dealt 5 cards and each discards 1 card prior to splitting the cards into half-hands.

28. The method of claim 1, wherein the dealer area comprises:

a chip rack;

a HIGH half-hand region into which the dealer places its selected higher half-hand;

a LOW half-hand region into which the dealer places its selected lower half-hand;

a discard rack; and a card shoe; and wherein each of the plurality of player areas comprises:

a chip area;

a HIGH half-hand region into which players place their selected higher half-hand; and a LOW half-hand region into which players place their selected lower half-hand.

29. A method of playing a card game, comprising the steps of:

providing a standard deck of cards each of said cards having a face value;

having a dealer deal a set of cards from the standard deck of cards to each of a plurality of players and to the dealer itself, an equal number of cards being dealt to each player, wherein each of said players and said dealer are dealt 4 cards, wherein each of said players is permitted to discard one of said 4 dealt cards dealt to them and draw a replacement card upon the payment of a fee, and wherein said dealer is permitted to discard a card and draw a replacement card only if said 4 dealt cards dealt to said dealer meet a predetermined criteria; wherein said predetermined criteria comprises when at least 3 of said 4 dealt cards dealt to said dealer are equal in value and when at least 3 of said 4 dealt cards dealt to said dealer are one of a 6, 7, 8, or 9; wherein the step of having a dealer deal a set of cards to each of a plurality of players and to the dealer itself further comprises:

providing a game table including a dealer area and a plurality of player areas; and wherein the dealer deals the set of cards into the dealer area and the plurality of player areas at the start of each game;

having each player make a single wager prior to viewing the face value of their respective cards;

having each player split their respective set of cards into a total number of cards in two half-hands, by forming a first half-hand having a LOW value card combination and a second half-hand having a HIGH value card combination wherein the total number of cards in either half-hand does not exceed the total number of cards in the other half-hand by more than one card;

having the dealer split its set of cards into two half-hands, a first half-hand having a LOW value and a second half-hand having a HIGH value wherein the total number of cards in either half-hand does not exceed the total number of cards in the other half-hand by more than one card;

designating a player as a winner if both (a) that player's LOW hand is lower than the dealer's LOW hand and (b) that player's HIGH hand is higher than the dealer HIGH hand.

30. The method of claim 29, wherein the dealer area comprises:

a chip rack;

a HIGH half-hand region into which the dealer places its selected higher half-hand;

a LOW half-hand region into which the dealer places its selected lower half-hand;

a discard rack; and a card shoe; and wherein each of the plurality of player areas comprises:

a chip area;

a HIGH half-hand region into which players place their selected higher half-hand; and a LOW half-hand region into which players place their selected lower half-hand.

31. A method of playing a card game, comprising the steps of:

providing a standard deck of cards each of said cards having a face value;

having a dealer deal a set of cards from the standard deck of cards to each of a plurality of players and to the dealer itself, an equal number of cards being dealt to each player, said equal number being from 3 to 7; wherein the step of having a dealer deal a set of cards to each of a plurality of players and to the dealer itself further comprises:

providing a game table including a dealer area and a plurality of player areas; and wherein the dealer deals the set of cards into the dealer area and the plurality of player areas at the start of each game;

having each player make a single wager prior to viewing the face value of their respective cards;

having each player split their respective set of cards into a total number of cards in two half-hands, by forming a first half-hand having a LOW value card combination and a second half-hand having a HIGH value card combination wherein the total number of cards in either half-hand does not exceed the total number of cards in the other half-hand by more than one card;

having the dealer split its set of cards into two half-hands, a first half-hand having a LOW value and a second half-hand having a HIGH value wherein the total number of cards in either half-hand does not exceed the total number of cards in the other half-hand by more than one card;

designating a player as a winner if both (a) that player's LOW hand is lower than the dealer's LOW hand and (b) that player's HIGH hand is higher than the dealer HIGH hand;

and further including the step of allowing a player to co-bank a hand with the dealer for a fee provided the banking player has enough money to pay 50% of all potentially winning wagers to all remaining non-banking players.

32. The method of claim 31, wherein the dealer area comprises:

a chip rack;

a HIGH half-hand region into which the dealer places its selected higher half-hand;

a LOW half-hand region into which the dealer places its selected lower half-hand;

a discard rack; and a card shoe; and wherein each of the plurality of player areas comprises:

a chip area;

a HIGH half-hand region into which players place their selected higher half-hand; and a LOW half-hand region into which players place their selected lower half-hand.

33. A method of playing a card game, comprising the steps of:

providing a standard deck of cards each of said cards having a face value;

having a dealer deal a set of cards from the standard deck of cards to each of a plurality of players and to the dealer itself, an equal number of cards being dealt to each player, said equal number being from 3 to 7; wherein the step of having a dealer deal a set of cards to each of a plurality of players and to the dealer itself further comprises:

providing a game table including a dealer area and a plurality of player areas; and wherein the dealer deals the set of cards into the dealer area and the plurality of player areas at the start of each game;

having each player make a single wager prior to viewing the face value of their respective cards;

having each player and said dealer discard a predetermined number of the dealt cards, wherein the said predetermined number of the cards is the amount of cards necessary to leave each said player and said dealer with 4 cards;

having each player split their respective set of cards into a total number of cards in two half-hands, by forming a first half-hand having a LOW value card combination and a second half-hand having a HIGH value card combination wherein the total number of cards in either half-hand does not exceed the total number of cards in the other half-hand by more than one card;

having the dealer split its set of cards into two half-hands, a first half-hand having a LOW value and a second half-hand having a HIGH value wherein the total number of cards in either half-hand does not exceed the total number of cards in the other half-hand by more than one card;

designating a player as a winner if both (a) that player's LOW hand is lower than the dealer's LOW hand and (b) that player's HIGH hand is higher than the dealer HIGH hand.

34. The method of claim 33, further including the step of allowing a player to bank a hand for a fee provided the banking player has enough money to pay 100% of all potentially winning wagers to all remaining non-banking players.

35. The method of claim 33, further including the step of allowing a player to co-bank a hand with the dealer for a fee provided the banking player has enough money to pay 50% of all potentially winning wagers to all remaining non-banking players.

36. The method of claim 33, wherein the dealer area comprises:

a chip rack;

a HIGH half-hand region into which the dealer places its selected higher half-hand;

a LOW half-hand region into which the dealer places its selected lower half-hand;

a discard rack; and a card shoe; and wherein each of the plurality of player areas comprises:

a chip area;

a HIGH half-hand region into which players place their selected higher half-hand; and a LOW half-hand region into which players place their selected lower half-hand.

* * * * *